US006267531B1

(12) United States Patent
Clarke

(10) Patent No.: US 6,267,531 B1
(45) Date of Patent: Jul. 31, 2001

(54) PAVING ASSEMBLY

(75) Inventor: Cameron John Ross Clarke, Delgany (IE)

(73) Assignee: Shapes & Solutions Limited, Delgany (IE)

( * ) Notice: Subject to any disclaimer, the term of this patent is extended or adjusted under 35 U.S.C. 154(b) by 0 days.

(21) Appl. No.: 09/283,743

(22) Filed: Apr. 2, 1999

(30) Foreign Application Priority Data

Apr. 2, 1998 (IE) ..... 980238

(51) Int. Cl.[7] ..... E01C 5/00; E02B 3/12

(52) U.S. Cl. ..... 404/34; 404/45; 404/72; 249/4; 264/257; 405/16

(58) Field of Search ..... 404/18, 34, 35, 404/45, 72; 264/251, 252, 257, 260; 405/16, 17, 20; 249/4, 10, 60, 207

(56) References Cited

U.S. PATENT DOCUMENTS

| | | | | |
|---|---|---|---|---|
| 4,226,060 | | 10/1980 | Sato . | |
| 5,053,264 | * | 10/1991 | Beretta | 428/131 |
| 5,268,137 | * | 12/1993 | Scott et al. | 264/225 |
| 5,486,066 | * | 1/1996 | Hagenah | 404/45 |
| 5,588,775 | * | 12/1996 | Hagenah | 404/45 |
| 5,775,838 | * | 7/1998 | Pettee, Sr. | 405/20 |
| 5,807,024 | * | 9/1998 | Benedict | 405/32 |

FOREIGN PATENT DOCUMENTS

| | | |
|---|---|---|
| 0 110 780 | 6/1984 | (EP) . |
| 0 288 247 | 10/1988 | (EP) . |
| 0 655 530 | 5/1995 | (EP) . |
| 2 072 156 | 9/1981 | (GB) . |
| 2169327 | 7/1986 | (GB) . |
| 93/07339 | 4/1993 | (WO) . |
| WO93/07339 | 4/1993 | (WO) . |
| 93/10310 | 5/1993 | (WO) . |

* cited by examiner

*Primary Examiner*—H. Shackelford
*Assistant Examiner*—Gary S. Hartmann
(74) *Attorney, Agent, or Firm*—Jacobson, Price, Holman & Stern, PLLC

(57) ABSTRACT

A paving assembly including a plurality of paving elements interconnected by a joining mesh. The mesh has a number of spaced-apart flat portions between the paving elements and a number of reinforcing portions of generally triangular shape extending into the body of the paving elements. A mold base has recesses to receive settable cementitious material and an insert tool is used to insert the mesh into the settable material. On setting, the paving assembly thus formed is readily removed from the mold base by inverting the base.

15 Claims, 6 Drawing Sheets

PAVING ASSEMBLY

INTRODUCTION

The invention relates to a paving assembly of the type comprising a plurality of paving elements interconnected by a joining mesh. The invention also relates to a method and an apparatus for forming such an assembly.

The term paving as used in this specification refers not only to areas which are covered to encourage access but also to ground covering in general including deterrent paving which may include features to discourage access.

GB 2169327 A describes a paving assembly incorporating slab-like elements connected together by flexible elongate connection means.

Paving assemblies comprising a plurality of paving elements interconnected by a joining mesh are described in WO-A-9307339.

There is a need for an improved paving assembly which is quick and inexpensive to manufacture. This invention is directed towards providing such a paving assembly.

STATEMENTS OF INVENTION

According to the invention there is provided a method of forming a paving assembly of the type comprising a plurality of paving elements interconnected by a joining mesh, the method comprising the steps of:

filling a mould having a plurality of separate paving element-forming recesses with a settable material;

applying a joining mesh over the recesses;

inserting at least portion of the mesh into the recesses;

setting the material to form a paving assembly comprising a plurality of paving elements interconnected by the joining mesh; and removing the paving assembly from the mould.

The insertion of the joining mesh into the plurality of separate recess ensures that the mesh is positively located and held in position, on setting. This provides the strength required for handling while providing sufficient flexibility at the joints between individual paving elements on installation to effectively and efficiently cover a desired area.

In one embodiment of the invention the paving element-forming recesses are defined between a number of spaced-apart supports and the mesh is laid on the supports and across the recesses prior to insertion of portion of the mesh into the recesses.

Preferably a plane through the top of the support defines the base of the paving elements.

In one embodiment of the invention portion of the mesh is inserted into the settable material by engaging the mesh with an insert tool, driving the tool into the settable material, and removing the tool. This is an especially advantageous feature as the insertion of the mesh is greatly simplified.

Preferably the insert tool includes at least one mesh engaging projection corresponding to each paving element-forming recess, the projection being inserted to drive the mesh into the settable material.

In a preferred embodiment of the invention the recesses are at least partially filled with settable material before insertion of the mesh. This feature is important in enhancing the handling strength without adversely affecting the required flexibility.

Most preferably the recesses are substantially filled with settable material before insertion of the mesh. This simplifies the production process as only one filling step is required.

In a preferred embodiment the mesh is of a plastics material. Such a mesh assists in providing the required flexibility while retaining the elements together.

The mesh may be of a biodegradable material.

In a preferred embodiment the settable material is a cementitious material. This is preferred as such materials are relatively cheap, readily available and easily processed.

The invention also provides an apparatus for forming a paving assembly of the type comprising a plurality of paving elements interconnected by a joining mesh, the apparatus comprising a mould having a plurality of paving element-forming recesses, and means for inserting portion of a joining mesh into the recesses.

The apparatus is of very simple construction, inexpensive and easy to operate.

Preferably the mesh inserting means comprises an insert tool which is engaged with the mesh and driven into a settable material in the recesses.

The insertion means provides a relatively simple and effective way of inserting the mesh onto the settable material. The tool may be inserted manually or by any suitable mechanical means.

Preferably to assist insertion of the mesh, the insert tool has a number of mesh-engaging projections. Ideally, for uniform insertion of the mesh over an area, there is at least one mesh engaging projection associated with each element-forming recess.

For efficient insertion, especially over a large area, the projection may be of varying lengths. For example, the projections towards the middle of an area may be longer than those at the outer periphery.

The projections may include mesh locating means such as mesh-receiving recesses or the like.

The invention also provides a paving assembly comprising a plurality of separate paving elements interconnected by a joining mesh, the joining mesh having a plurality of connecting portions which extend between the paving elements and a number of retaining portions which extend into the paving elements from the connecting portions.

In a preferred embodiment the connecting portions of the mesh extend between the bases of the separate paving elements.

Preferably the connecting portions of the mesh are generally flat portions.

Typically, the reinforcing portions are generally of triangular form.

BRIEF DESCRIPTION OF THE DRAWINGS

The invention will be more clearly understood from the following description thereof given by way of example only with reference to the accompanying drawings in which.

DETAILED DESCRIPTION

Figure 3:
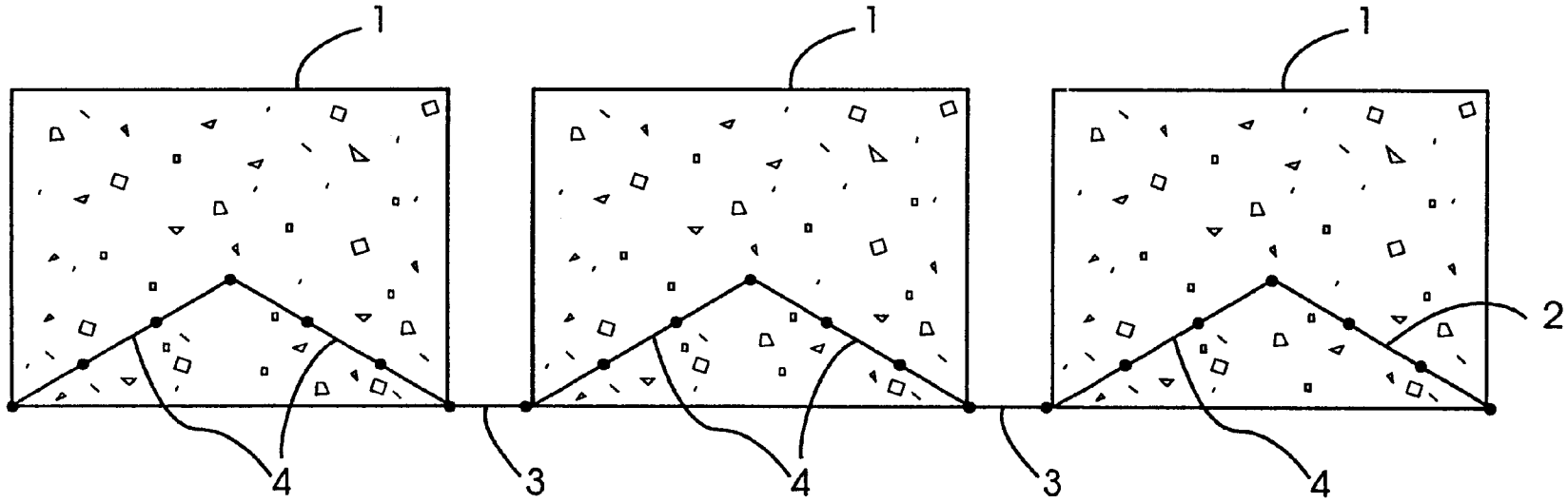
FIG. 3 is a cross sectional view of a paving assembly of the invention.
Figure 4:
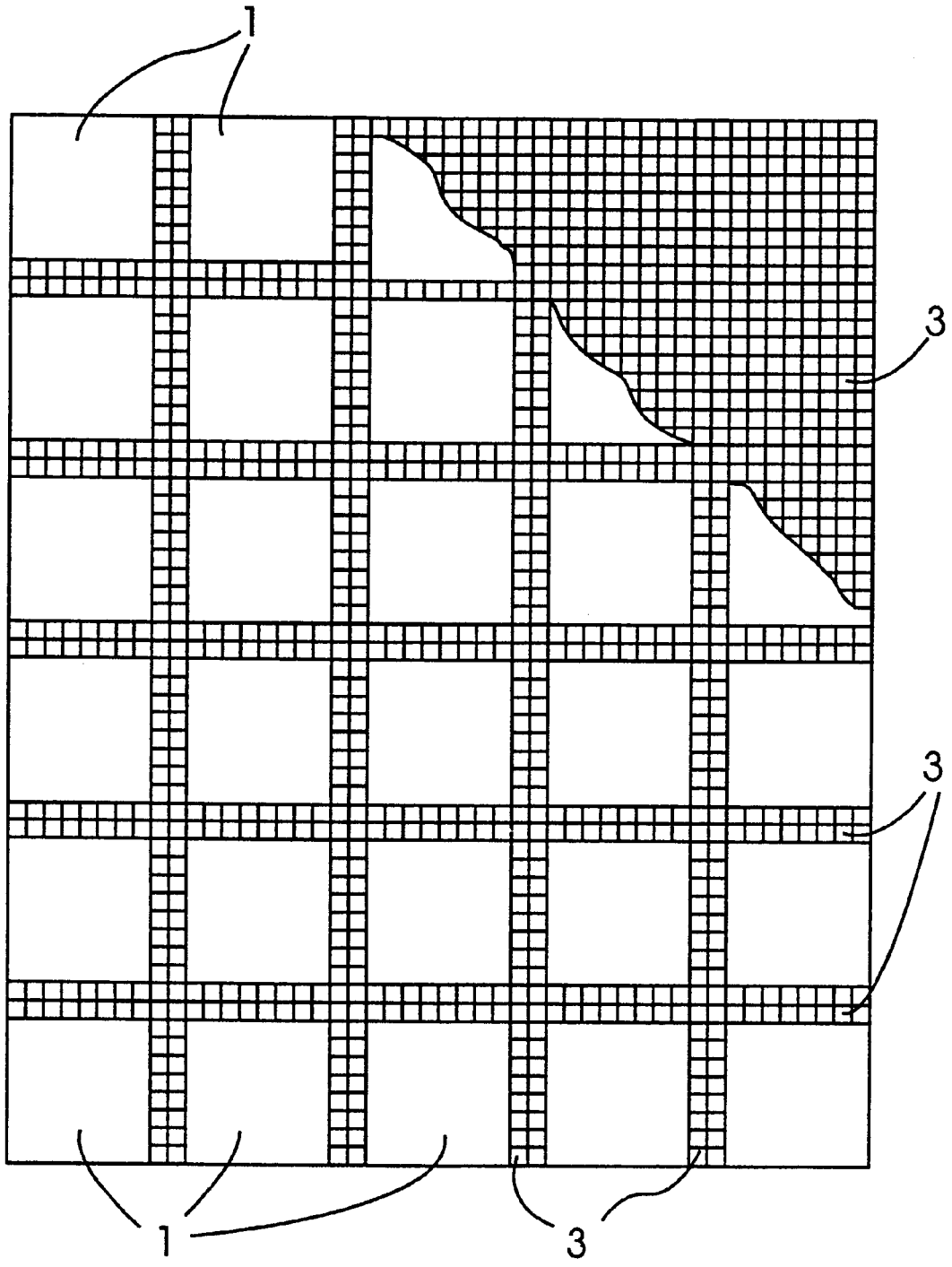
FIG. 4 is a perspective view of a typical laid paving assembly.

Referring to the drawings there is illustrated in FIG. 3 a paving assembly according to the invention comprising a plurality of separate paving elements 1 interconnected by a joining mesh 2. The paving elements 1 are usually of a settable cementitious material and the mesh 2 is an interconnecting mesh of flexible material extending between the paving elements 1.

The mesh 2 comprises a number of spaced-apart flat portions 3 between the bases of the paving elements 1 and a number of shaped portions 4 extending into the body of the paving elements 1. In this case the shaped portions 4 are of generally triangular shape to efficiently interconnect the elements 1.

Figure 1:
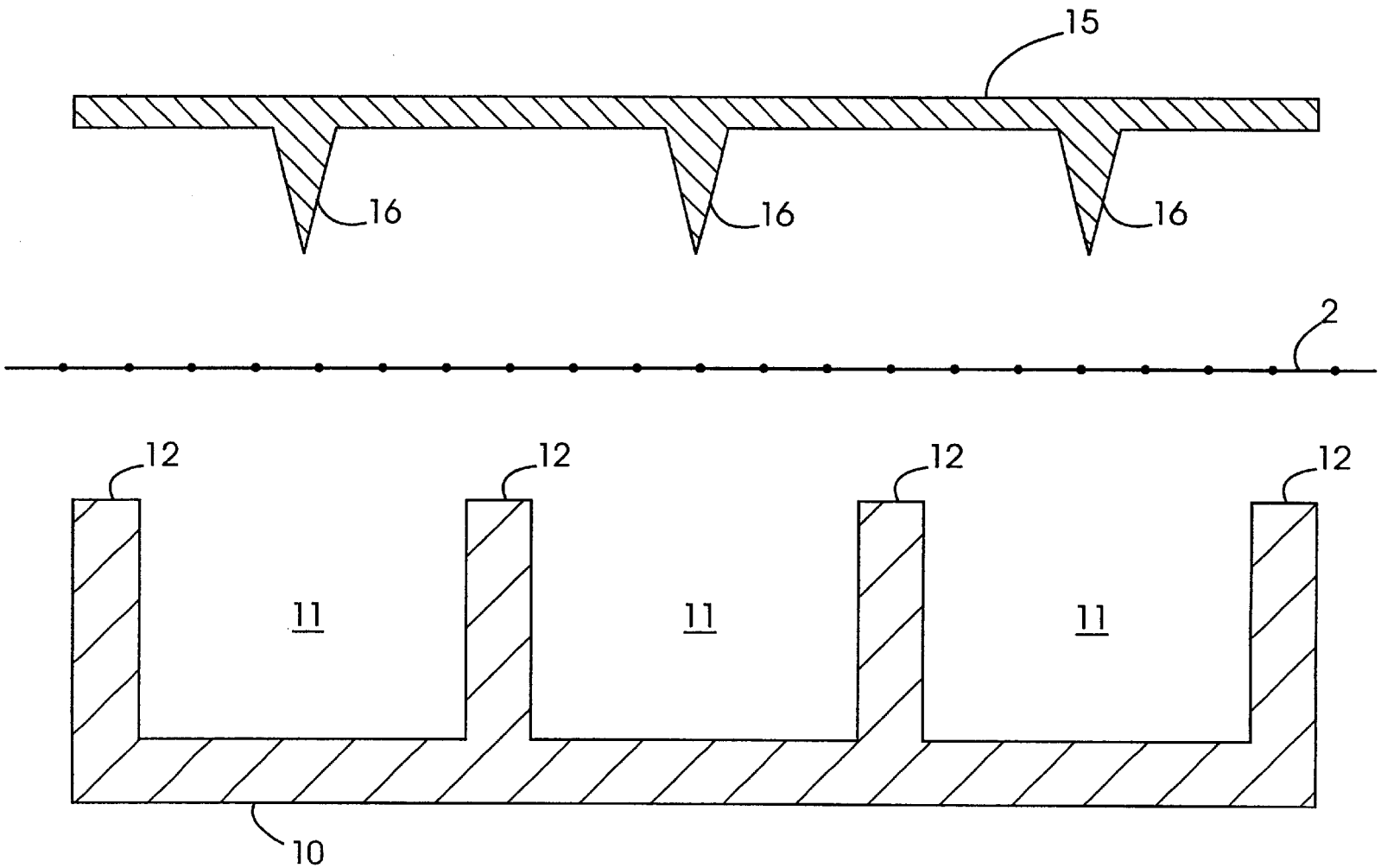
FIGS. 1 and 2 are side cross sectional views illustrating the method and apparatus of the invention.
Figure 2:
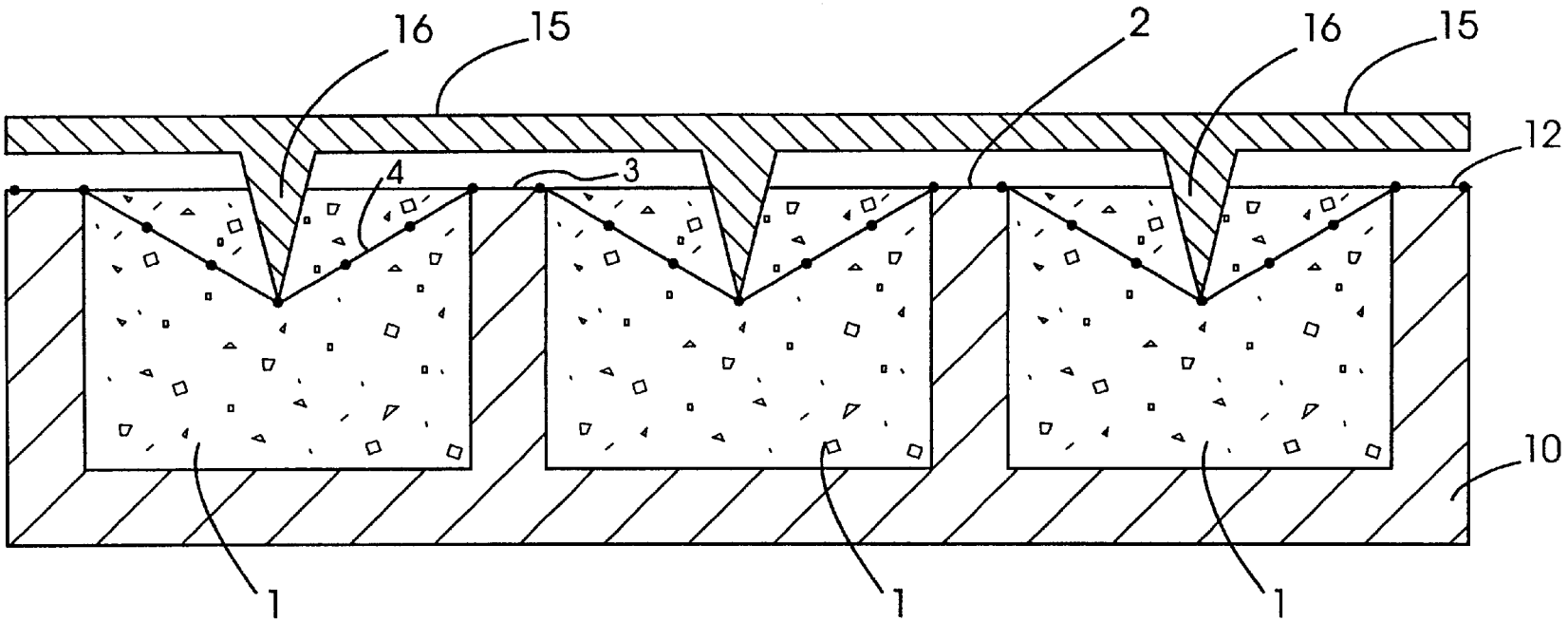

The paving assembly is formed using the method and apparatus illustrated in FIGS. 1 and 2. The apparatus comprises a mould base 10 having a plurality of recesses 11 for receiving a settable cementitious material which forms, on setting, the paving elements 1. The mould base 10 includes a number of upstanding support walls 12 which define the recesses 11. The mesh 2 is laid on the top surface of the support walls 12. The apparatus also includes a mesh inserting means in the form of a tool 15 having a number of projections 16, at least one projection per recess 11. This will result in the triangular configuration of the shaped portion 4. However a different configuration will result depending on the number of projections 16 per recess 11.

The mesh is sufficiently flexible to allow it to be inserted into the mould while providing sufficient dimensional stability to allow it to be readily laid on the support walls of the mould. The mesh for example, may be of polypropylene or Nylon material.

The projections 16 may be of any suitable size and shape to achieve the insertion of the mesh 2 into the cementitious material. For efficient insertion, particularly over a large area, some of the projections 16 may be longer than others. For example, in the insert tool illustrated, the middle projection extends for a greater distance into the cementitious material In this way locking of the mesh against insertion is avoided.

In use, the mould base 10 is arranged with the recesses 11 uppermost as illustrated in FIG. 1. Settable cementitious material is then poured into the recesses up to the level of the top of the walls 12. The mesh 2 is then placed over the settable material in the mould and on top of the walls. The insert tool 15 is driven downwardly so that the projections 16 are engaged with portions of the mesh 2 and portion of the mesh is inserted into the settable material as illustrated in FIG. 2. At this stage the cementitious material has not set and after withdrawal of the inset tool 15 the mesh 2 remains in position in the material and the material fills the voids created by the projections 16 as they are withdrawn. Vibration may be applied during moulding.

The cementitious material is allowed to set and the paving assembly thus formed is readily removed from the mould base 10 by inverting the base.

The invention provides a paving assembly which is extremely quickly and easily formed. Only a single mould part is required and no threading of reinforcement is required. A mesh is simply laid down and using an insert tool, part of the mesh is positively and efficiently embedded in the settable material. The connecting flat portions of the mesh between the bases of the paving elements greatly assists the flexibility of the paving assembly which can be quickly and easily laid. The flexibility of the mesh between the individual paving elements allows the paving assembly to be readily shaped to form radii and the like.

Figure 5:
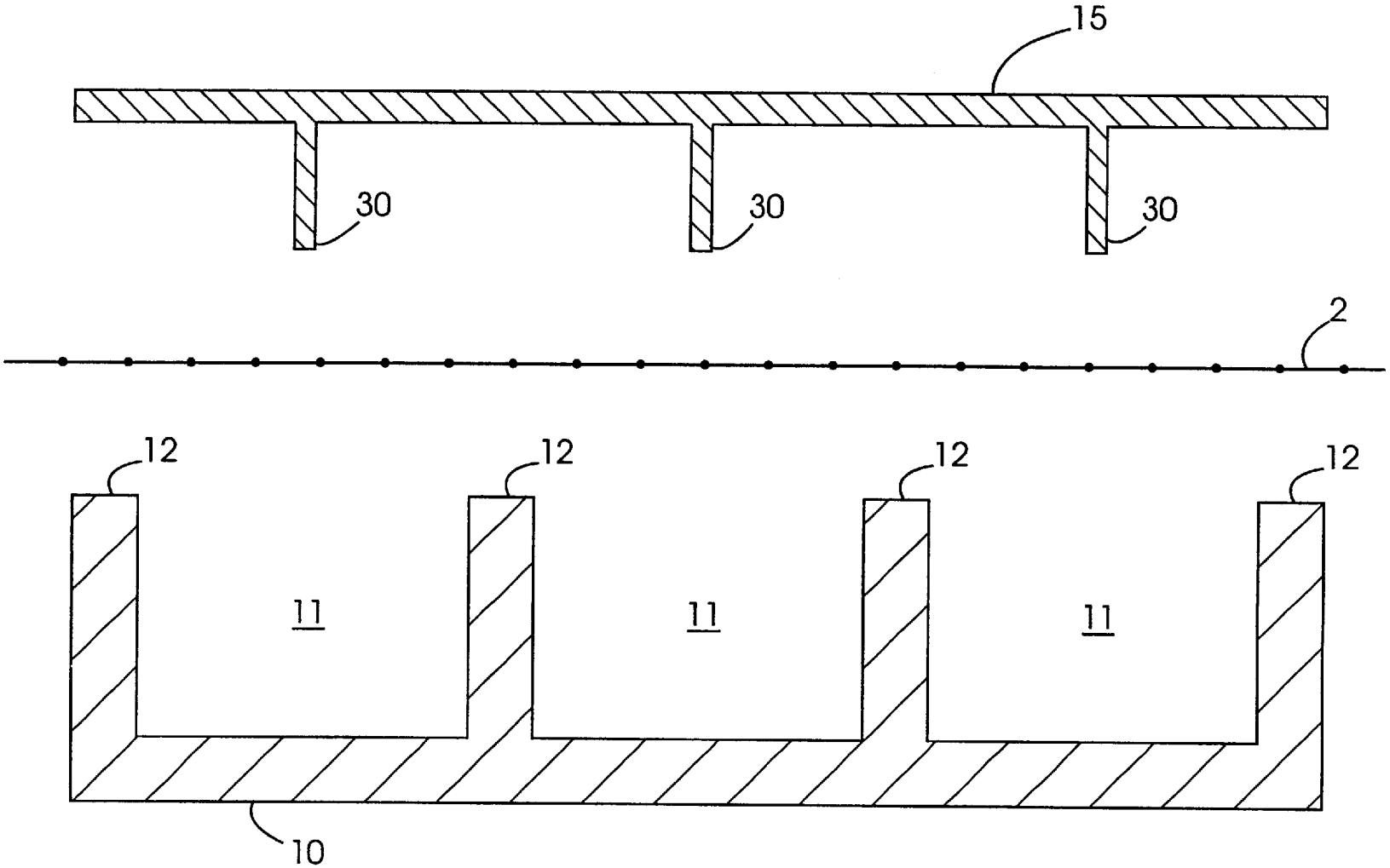
FIGS. 5 and 6 are side cross sectional views of a modified paving-forming apparatus of the invention.
Figure 6:
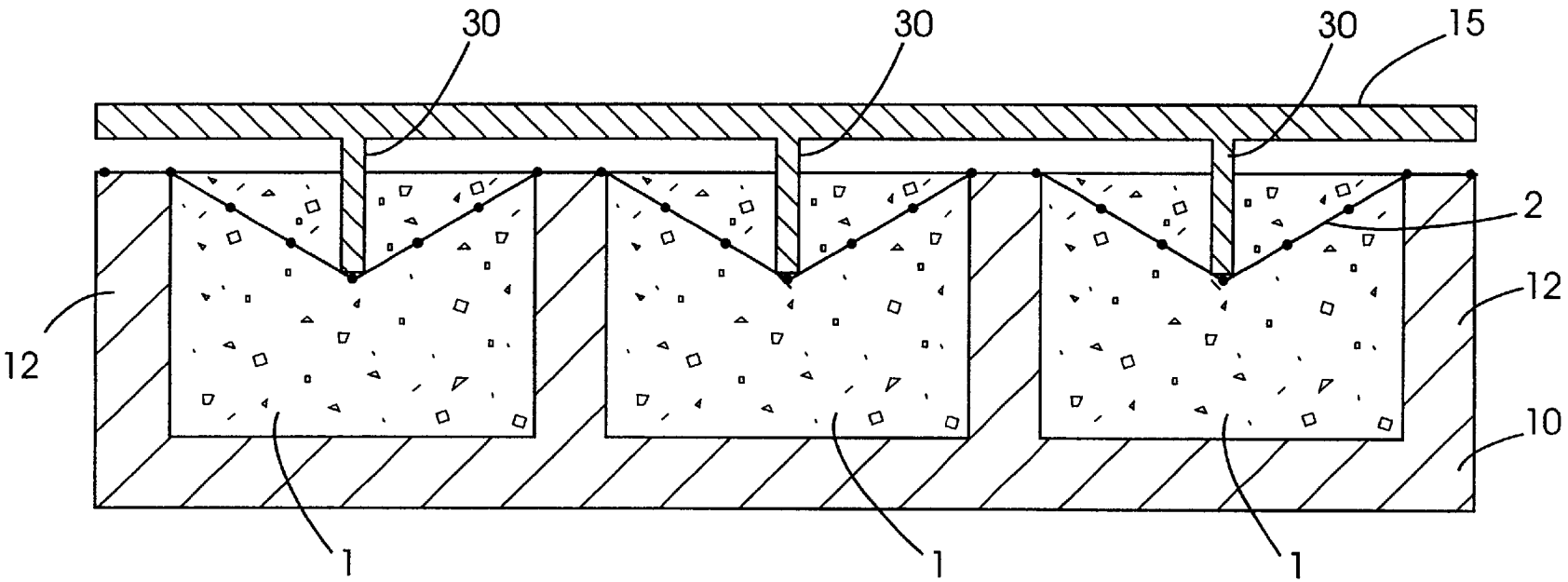

Referring in particular to FIGS. 5 and 6 there is illustrated another apparatus for forming a paving assembly which is similar to the apparatus of FIGS. 1 and 2 and like parts are assigned the same reference numeral. In this case projections 30 which extend to insert the mesh 2 into the cementitious material are of generally flat shape. We have found in use that it is not essential to provide pointed ends.

It will be appreciated that the paving elements may be of desired shape and configuration. In some cases the paving may be provided with projections to define a deterrent paving system.

Many variations on the invention will be readily apparent and accordingly the invention is not limited to the embodiments hereinbefore described which may be varied in construction and detail.

What is claimed is:

1. A method of forming a paving assembly comprising a plurality of paving elements interconnected by a joining mesh, the method comprising the steps of:

filling a mould having a plurality of separate paving element-forming recesses with a settable material, the paving element-forming recesses being defined between a number of spaced apart supports;

applying a joining mesh over the recesses, the mesh being laid on the supports and across the recesses;

engaging the mesh with an insert tool having at least one mesh projection corresponding to each paving element-forming recess;

driving the projections and hence the mesh into the settable material to move the mesh into a general triangular configuration extending into the settable material from points located at two adjacent supports of said spaced-apart supports;

removing the insert tool;

setting the material to form a paving assembly comprising a plurality of paving elements interconnected by the joining mesh with the joining mesh extending continuously between adjacent paving elements and continuously through the paving elements; and removing the paving assembly from the mould.

2. A method as claimed in claim 1, wherein a plane through a top of the supports defines a base of the paving elements.

3. A method as claimed in claim 1 wherein the recesses are at least partially filled with settable material before insertion of the mesh.

4. A method as claimed in claim 1 wherein the mesh is of a flexible material.

5. A method as claimed in claim 1 wherein the mesh is of biodegradable mate.

6. A method as claimed in claim 1 wherein the settable material is a cementitious material.

7. A method as claimed in claim 1 wherein the mesh is of a plastics material.

8. Apparatus for forming a paving assembly comprising a plurality of separate paving elements interconnected by a joining mesh, the apparatus comprising a mould having a plurality of paving element-forming recesses between spaced apart supports, and means for inserting a portion of a joining mesh into the recesses in a continuous general triangular configuration extending from adjacent supports, the mesh inserting means comprises an insert tool which is engaged with the mesh and driven into a settable material in the recesses, the insert tool having a number of mesh-engaging projections, at least one mesh engaging projection being associated with each paving element forming recess.

9. Apparatus as claimed in claim 8 wherein the projections are of varying length.

10. Apparatus as claimed in claim 8 wherein the paving element-forming recesses are defined between a number of spaced-apart supports, the top of the supports defining a mesh receiving area.

11. A paving assembly comprising a plurality of separate paving elements interconnected by a joining mesh having a plurality of connecting portions which extend between outermost edges of the paving elements and a number of continuous retaining portions of generally triangular form continuous with the connecting portions which extend into the paving elements from the connecting portions at a continuous incline from the outermost edges of the paving elements.

12. A paving assembly as claimed in claim 11 wherein the connecting portions of the mesh extend between the bases of the separate paving elements.

13. A paving assembly as claimed in claim 11 wherein the connecting portions of the mesh are generally flat portions.

14. A method of forming a paving assembly comprising a plurality of paving elements interconnected by a joining mesh, the method comprising the steps of:

filling a mould having a plurality of separate paving element-forming recesses with a settable material;

applying a joining mesh over the recesses;

engaging the mesh with an insert tool having at least one mesh projection corresponding to each paving element forming recess, the projections being of variable length;

driving the projections and hence the mesh into the settable material;

removing the insert tool;

setting the material to form a paving assembly comprising a plurality of paving elements interconnected by the joining mesh; and removing the paving assembly from the mould.

15. Apparatus for forming a paving assembly comprising a plurality of separated paving elements interconnected by a joining mesh, the apparatus comprising a mould having a plurality of paving element-forming recesses, and means for inserting a portion of a joining mesh into the recesses, the mesh inserting means comprising an insert tool having a number of mesh engaging projections which are engaged with the mesh and driven into a settable material in the recess, the projections being of varying length.

* * * * *